United States Patent [19]

Moussouris

[11] Patent Number: 4,750,245

[45] Date of Patent: Jun. 14, 1988

[54] GEMSTONE MOUNTING APPARATUS AND METHOD

[76] Inventor: Alexandros Moussouris, 4145-212 Porte De Palmas, San Diego, Calif. 92122

[21] Appl. No.: 920,519

[22] Filed: Oct. 17, 1986

[51] Int. Cl.[4] ..... B23P 5/00

[52] U.S. Cl. ..... 29/10; 408/16; 269/94; 269/157; 29/160.6

[58] Field of Search ..... 29/10, 160.6, 560, 26 A, 29/26 R; 269/91, 94, 157, 246; 408/14, 16; 72/481

[56] References Cited

U.S. PATENT DOCUMENTS

| | | | |
|---|---|---|---|
| 919,596 | 4/1909 | Kirkwood | 29/10 |
| 980,060 | 12/1910 | Buser | 29/10 |
| 1,499,818 | 7/1924 | Franconetti | 409/143 |
| 1,546,814 | 7/1925 | Toy | 29/10 |
| 2,533,870 | 12/1950 | Bayer | 81/7 |
| 2,803,210 | 8/1957 | Lohman | 113/111 |
| 3,751,795 | 8/1973 | Favre | 29/558 |
| 3,773,312 | 11/1973 | Victorino | 269/50 |
| 3,839,770 | 10/1974 | Favre | 29/10 |
| 3,911,722 | 10/1975 | Levine et al. | 72/479 |
| 4,295,640 | 10/1981 | Merrell | 269/47 |
| 4,448,304 | 5/1984 | Weinzettel et al. | 206/223 |
| 4,621,407 | 11/1986 | Suzuki | 29/26 A |
| 4,637,107 | 1/1987 | Romeu | 29/560 |

*Primary Examiner*—P. W. Echols

*Attorney, Agent, or Firm*—Brown, Martin, Haller & Meador

[57] ABSTRACT

An apparatus for mounting gemstones in prong type settings by cutting a seat in the form of an inset edge in the ends of the prongs and swaging the remaining prong material over a stone girdle, comprising a vertical support frame holding a tool driver such as a rotating chuck assembly slidably mounted thereon for sliding between first and second predetermined limits of travel. A rotary cutting tool is coupled to the tool driver for being rotated and removing predetermined portions of the prong ends. A cylindrical mandrel or vise clamp holder is mounted on a work platform attached to the frame and positions the setting under the cutting tool. The setting is held in a fixed vertical but self adjusting lateral or horizontal position which provides automatic centering of the mounting operation. A reciprocating element moves the tool driver up or down on the vertical frame with a stop being employed to control spacing between the cutting tool and the setting. A swaging element which is removably coupled to the tool driver contacts the ends of setting prongs after being cut and bends a predetermined portion of the prong ends over the girdle of the stone.

20 Claims, 4 Drawing Sheets

GEMSTONE MOUNTING APPARATUS AND METHOD

BACKGROUND OF THE INVENTION

1. Field of the Invention

The present invention relates to jewelry and gemstones and more particularly to an apparatus for mounting gemstones in jewelry settings. The present invention further relates to apparatus for forming an inset seat in a prong type jewelry setting which receives a gemstone and then swaging the ends of the prongs over the girdle of the stone without repositioning the setting relative to the mounting apparatus.

2. Background

Many gemstones are secured in place in jewelry settings using formed meal or metal projections that extend over the top of the stone table to hold the stone against a seat comprising a recessed edge or projection within a mounting structure.

A typical stone mounting or setting structure for precious or semi-precious stones such as diamonds, is a solitary tiffany setting or cage which comprises a series of spaced apart supports commonly known as "prongs". Standard stone settings use 4 or 6 prongs, although the number varies according to the size of the setting or gemstone. The prongs generally extend up and outward at an angle from a mounting surface, such as a ring or a stud base, and are grouped symmetrically about a central mounting location. In some jewelry settings the prongs extend straight up from a mounting surface or circular ring in a right circular cylindrical pattern. In either case, when viewed from above the top of the prongs form a circular pattern.

In order to form a seat or inset resting edge for the stone a jeweler, stone setter, or technicial uses deburring, or cutting tools to remove material from the inner edge of the ends of the prongs. Enough material is removed from each prong to form an inset edge large enough to accommodate the stone girdle dimensions but not enough to make the stone loose or the support prongs weak.

The seat preparation is generally performed using a hand held rotary power tool, such as an electrically powered drill head or chuck, to drive a deburring or cutting tool. An exemplary deburring tool is disclosed in U.S. Pat. No. 980,060, issued Dec. 27, 1910 to J. J. Buser. Operation of such tools requires a great deal of skill and time to create the desired gemstone mounting. It is time consuming because material is removed from each of the 4 to 6 prongs (depending upon the type of setting) one at a time. The process is very exacting because care must be taken to adjust the inset or edge formed in each prong to the same depth and approximate width to maintain the strength and aesthetics of the setting.

Once the seat is prepared, the gemstone is placed in the setting and the ends of the prongs extending above the girdle are bent over the outer edge of the stone. In bending the metal over the stone, especially with hard jewelry metals, care must be taken not to damage the stone. If the tools used for the bending procedure drive against the stone in any way then there is a risk of cracking the stone. At the same time, hard materials such as diamonds can deflect a misguided tool and cause it to strike the stone setter, causing injury and a corresponding loss of productivity.

It is very desirable to be able to produce a large number of seats for gemstones in a short amount of time and with a fairly low degree of skill in order to reduce costs and increase related profits and production rates. This is especially true where large numbers of similar or identical gemstones are mounted in identical settings in jewelry manufacturing operations. The degree of skill that is required for the setting has hampered development of cost effective large scale stone mounting operations. Merely working faster and in larger numbers leads to mistakes and inaccuracies that degrade the jewelry quality.

There have been devices made in an attempt to mechanize some of the stone mounting steps. One such device is an apparatus for swaging gem mounts as disclosed in U.S. Pat. No. 3,839,770, issued Oct. 8, 1974 to H. V. Favre. The Favre patent discloses a device that performs the closing, crimping, or swaging of claws over a stone placed in a clawed setting. While the device of Favre allows the setting of a stone by a less skilled individual, it does not address fine "pronged" jewelry settings. Claw type settings are generally used on inexpensive stones or jewelry such as in setting rhinestones on clothing articles. These settings are not cut to form a seat as previously described but are preformed with thin prongs that are easily bent over the top of a stone.

Therefore, problems still remain with mechanizing or automating the gemstone mounting process for fine jewelry settings in terms of preparing a properly dimensioned and centered seat, and swaging a stone in the center of the seat. These and related problems have prevented the development of faster, high precision, high quality, lower cost, gemstone mounting for large volumes of gemstones.

SUMMARY OF THE INVENTION

Therefore, it is one purpose of the present invention to provide an apparatus for mounting gemstones in a fast and reproducably accurate manner.

It is an objective of the present invention to provide an apparatus for mounting of gemstones which automatically centers the seat and aligns the stones in a setting.

Another objective of the invention is to provide an apparatus for mounting gemstones which allows simplified repetitive operation for a series of similar jewelry settings.

Yet another objective of the invention is to provide an apparatus for mounting gemstones with a high degree of precision in a short amount of time by properly trained personnel having little or no jewelry or stone mounting experience.

These and other objectives, advantages, and purposes are realized in an apparatus for mounting gemstones in prong type jewelry settings comprising a vertical support frame on which a tool driver means is mounted so that it moves up and down along the frame between two positions defining limits of travel along the frame. A rotary cutting tool having a central longitudinal axis is mounted on the tool driver means and has a rotating cutting surface that removes portions of the ends of the prongs. A setting holder is mounted on the vertical support frame adjacent to the tool driver means so that it holds settings approximately centered under the cutting tool along the projection of the central axis. The setting holder is constructed to allow lateral movement of the setting transverse to the vertical support frame so that the setting automatically centers itself during cutting.

A means for reciprocating the tool driver means and, thus, the cutting tool up and down along the vertical frame is provided. Stop control means limits the motion of the tool driver means to control the depth of penetration of the cutting tool into the setting prongs. Once the cutting tool has reached its maximum depth the setting holder is secured in place to prevent further lateral movement.

A swage chuck holding a swaging socket for closing the ends of the prongs over a stone girdle is removably mounted on the tool driver, and a second stop means controls the pressure of the swaging socket against the setting prongs.

BRIEF DESCRIPTION OF THE DRAWINGS

The novel features of the present invention may be better understood from the accompanying description when taken in conjunction with the accompanying drawings in which like characters refer to like parts and in which.

DETAILED DESCRIPTION OF A PREFERRED EMBODIMENT

The present invention comprises an apparatus and method for automatically centering and mounting gemstones in cage or prong type jewelry settings. The apparatus operates by securely holding a setting, in the form of a ring or stud assembly, on a platform above which a cutting or deburring tool is positioned. The cutting tool removes a predetermined amount of material from all of the support prongs in the setting at the same time and to a predetermined depth. This forms a seat or ridge on which the stone is manually placed and where it rests on a lower edge of the stone. A removable swaging tool is mounted on the cutting tool assembly and engages the setting prongs to bend them over a stone girdle edge so that they extend above the girdle but below the stone table and secure the stone in place. This operation can be performed repetitively for a series of identical stone and setting sizes. Adjustment means are provided so that repetitive operations are performed in a highly accurate, non-desctructive, fast manner and mounting is accomplished without a high degree of jewelry skill.

Figure 1:
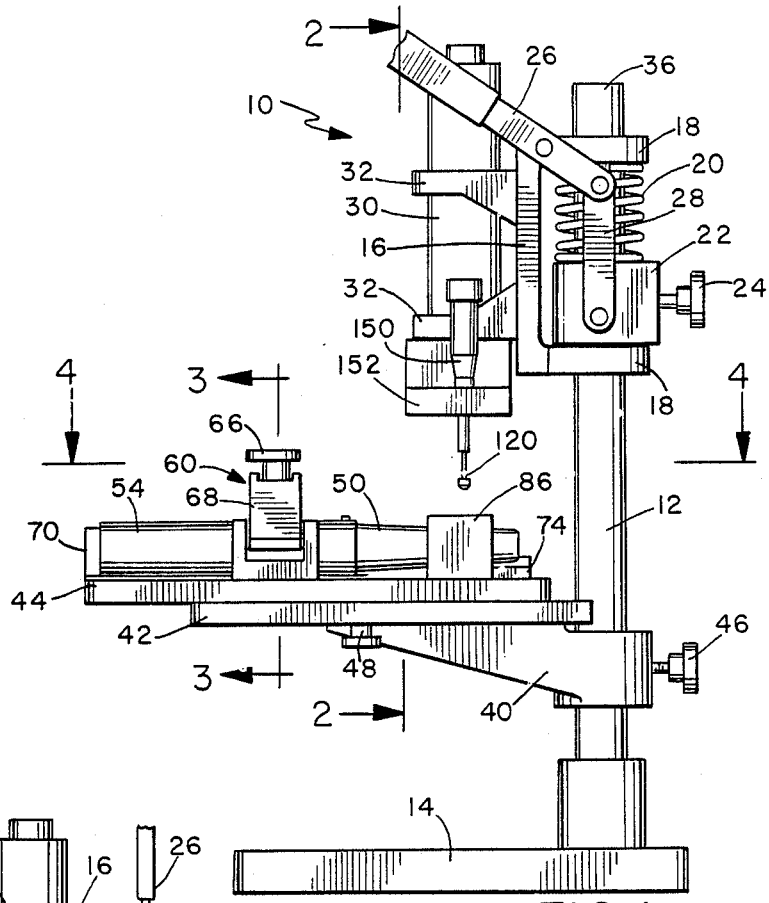
FIG. 1 is a side elevation view of a gem mounting apparatus constructed according to the principles of the present invention as set up to hold a ring type setting.

A preferred embodiment of a gemstone mounting apparatus constructed according to the principles of the present invention is illustrated in FIG. 1. FIG. 1 shows a side elevational view of a gem mounting appparatus 10, which has a vertical support frame or member 12 extending upward from a base plate 14. The support member 12 can comprise several alternate structures such as, but not limited to, a smooth steel pipe having walls thick enough to support the weight of the remaining components described below. The base plate 14 is preferably a steel plate having a threaded hole for accepting the base of the vertical support 12 which is also threaded. The base plate 14 can be provided with one or more mounting holes through which bolts or screws extend to secure the apparatus 10 in a preferred location on a work surface. The base plate 14 and vertical support 12 are configured the same as a small conventional drill press stand. Those skilled in the art will readily understand the manufacture of such a support frame as well as alternate construction materials.

Mounted on the vertical support 12 is a carriage 16 for holding or supporting a cutting tool driver 30. The vertical support 12 extends through two circular passages in carriage 16 support arms 18 so that the carriage 16 slides up and down on the vertical support 12. These passages are made large enough to allow relatively free vertical motion of the carriage 16 without binding. However, the support arm passages are made as close in size to the vertical support as possible in order to prevent substantial angular movements of the tool driver 30 which would decrease the precision of the stone mounting.

The carriage 16 is supported in fixed vertical positions by a spring 20 which rests on a carriage support block 22. The spring is a very stiff spring, preferably made of spring steel, which pushes the carriage 16 upward until the lower support arm 18 encounters the support block 22. The support block 22 has a central opening through which the vertical support 12 passes and uses a set screw or bolt 24 to fasten to the vertical support 12. The carriage 16 and support block 22 are made of materials such as steel or aluminum.

The vertical support 12, carriage 16, spring 20 and support block 22 cooperate in a manner similar to a typical machine drill press, as would be understood by those skilled in the machine arts. The cooperation of these components allows the carriage 16 to move up and down on the spring and support block assembly for a relative travel motion of a few inches. The spring and support assembly further employs a handle 26 which is pivotally secured in a lever fashion to the carriage 16 and to a pivot link 28 which is secured on one end to the support block 22. Movement of the handle up and down moves the carriage block 16 up and down on the vertical support 12.

The carriage 16 uses a tool mounting structure to support or hold in place a rotary action cutting or deburring tool driver 30. This is accomplished using two tool holding clamps 32 which fit around the body of the tool driver housing. The clamps 32 are configured as C-shaped, or split, blocks of material having a central opening or passage through which the housing of the tool driver 30 is inserted. The openings as well as the housing of the tool driver 30 can be circular or square in cross section depending upon the preferred tool driver 30 employed. A screw or bolt extending across the open side of the "C" portion of the clamps 32 acts to pull the clamps closed and hold the tool driver 30 in place. This type of clamp structure is known and understood in the machine arts and is not illustrated in further detail here. The clamps 32 are preferably molded as a unitary part of the carriage 16 but may be separately manufactured and fastened to the carriage.

Figure 2:
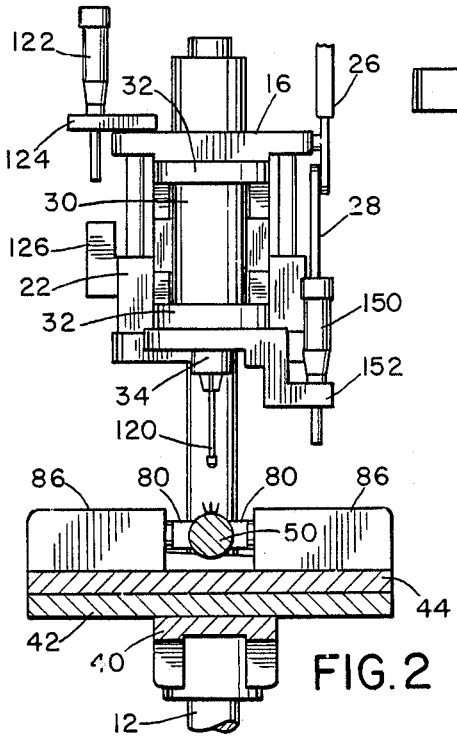
FIG. 2 is a sectional view taken on line 2—2 of FIG. 1.

The cutting tool driver 30 used in the apparatus 10 is a typical jewelers drill having a diameter on the order of 5.0 centimeters or less. The exact size varies with the application, power requirements, and general availability of standard sizes. The cutting tool driver 30 generally employs some type of internal gearing to turn a chuck 34, which is shown in FIG. 2 extending below a clamping block 32. The tool driver 30 can be powered by a small internal electric motor but is preferably powered by a remotely located motor through a flexible shaft attached to the upper end of the tool driver 30. The use of an external motor and shaft arrangement, not shown for clarity of illustration, allows very high speed and high power operation. This type of motor, flexible shaft, and rotary tool driver assembly is commonly used in the jewelry arts for powering hand held deburring and cutting apparatus. Therefore, the gemstone mounting apparatus 10 can utilize motor power sources already generally available.

Using a motor to power the tool driver 30 from a remote location means that the flexible shaft requires enough extra length to move freely up and down with the tool driver 30. This also means finding a convenient location for the motor and providing clearance for the flexible shaft. An alternative is to secure a motor assembly on the upper portion 36 of the vertical support 12 above the upper portion of carriage 16 so that only a small flexible shaft and no additional work surface is required for the motor.

Mounted on the vertical support 12 just below the carriage 16 and tool driver 30 assembly is a support arm 40 which attaches to the vertical support 12 and holds a work table 42 and a work plate 44. The support arm 40 is clamped to the vertical support 12 using means such as an adjustable set screw or bolt 46. The support arm 40 could also use a split block assembly, as used for the tool driver 30, to wrap around the vertical support and tighten in place. The work table 42 can be attached to the support arm using a variety of means such as counter sunk screws, bolts, or even welding. The work table 42 may have one or more holes for use in attaching other parts.

A work plate 44 is in turn attached to the work table 42 using two bolts or screws 48 that extend through holes in the work table 42 and into threaded holes in the work plate 44. The preferred embodiment uses bolts with small handles for turning the end of the bolts so that the working surface can be readily adjusted or tightened for new mounting operations when required. Also, a series of interchangeable work plates 44 can be made to accommodate a variety of preassembled setting holding devices.

The work table 42 is sufficiently large to support most of the area of the work plate 44 so that the work plate is very stable. This allows fastening bolts 48 to be loose enough to allow small lateral movements of the work plate 44 relative to the work table 42 or vertical support 12 without a shift in vertical position. At the same time, support arm 40 prevents the work plate 44 from moving down the vertical support 12, and pressure from the mounting operation prevents the work plate 44 from moving up the vertical support 12 or off work table 42. The advantage of this configuration will become clear from the description of operation below. This is important to the self aligning aspect of the invention.

In order to support the settings being worked on, special clamps, locating blocks, and holding structures are provided on the work plate 44. The first type of holding or support structure illustrated in FIGS. 1 through 6 is for a setting on a ring.

To secure a ring 76 in place, a tapered cylindrical support bar or mandrel 50 is used. The mandrel 50 can comprise a variety of materials but because of repetitive use and the friction of rings against the surface of the mandrel, it is preferably manufactured from a hard steel and finely polished to prevent damage to the rings. The mandrel 50 is tapered in a manner similar to the typical ring size indicator used in the jewelry arts. To accommodate a number of ring sizes a series of separate mandrels 50 are provided each with different angular tapers ranging from between 3 to 5 degrees and having appropriate lengths to provide support for ring sizes ranging from 2 through 14. However, special mandrels or mandrel sizes can be provided to accommodate other ring sizes for given applications.

One end of the mandrel 50 is a non-tapered cylindrical section for mounting into a recess 52 in the end of a mandrel holder 54 which can be made of a material such as aluminum. This is better illustrated in FIGS. 4 and 5, where mandrel 50 is shown inserted into the end 52 of a mandrel support 54 on top of the work plate 44. A slot or depression 56 formed in the cylindrical section of the mandrel 52 accepts a set screw 58 which locks the mandrel 50 in place on the mandrel holder 54. The cylindrical section is centered about a longitudinal axis running through the center of the mandrel so that regardless of the external angular shape, the mandrel is centered in the mandrel holder 54.

Figure 3:
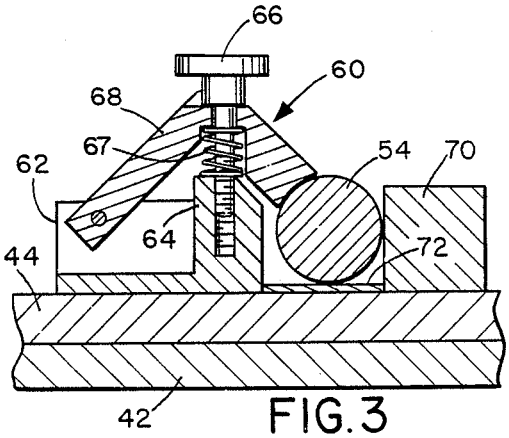
FIG. 3 is an enlarged sectional view taken on line 3—3 of FIG. 1.

The mandrel holder 54 is secured to the work plate 44 using a special mandrel clamp 60 which is illustrated in cross section in FIG. 3. The clamp 60 comprises a base clamp bracket 62 which is secured to the work plate 44 using screws or similar fastening means. The bracket 62 has a sidewall 64 with a threaded hole for a locking bolt 66 which has a large handle, for tightening against a clamp arm 68. Either the bolt or a threaded handle can turn to tighten. When bracket 62 is made of aluminum, a steel insert or a perpendicular steel rod can be inserted in the path of the threaded hole to have the hole pass through steel when bored and reduce wear during use.

The clamp arm 68 is "L" shaped and secured on at the end of the long side to the clamp bracket 62. The clamp arm 68 rests on the sidewall 64 with the end of the foot of the "L" contacting the mandrel holder 54. The bolt 66 passes through a hole in the front of the clamp arm 68. As the bolt or handle 66 is turned in one direction, the bolt handle tightens down on the clamp arm 68, and forces the arm against the mandrel holder 54. The end of the clamp arm 68 contacting the mandrel holder can be curved to improve contact and prevent slippage. As the bolt 66 is turned in the opposite direction, a spring 67 positioned around the bolt, presses against the clamp arm 68 and moves it upward. This quickly and evenly releases the mandrel holder 54.

The pressure on the mandrel holder 54 from the clamp arm 68 forces the mandrel holder against a locating block 70 attached to the work plate 44. The locating block 70 is positioned on the work plate 44 so that the mandrel holder will be approximately centered under the tool driver 30 when secured in place by the clamp 60.

The locating block 70, clamp 60 components, or work plate 44 can be made out of materials such as aluminum or steel. However, when aluminum is used, a scratch plate 72, which is preferably made of steel, will be mounted under the mandrel holder 54. This prvents scarring and depressions formed by repeated movement and tightening of the clamp 60 against the mandrel holder 54.

Since the mandrel 50 tapers to a narrower diameter along its length, the end of the mandrel 50 extending toward the vertical support 12 does not rest on a solid surface. While the mandrel 50 is an inflexible bar, for purposes of maximum support and precision, a wedge 74 is provided under the tapered end of the mandrel 50. The wedge 74 has a semicircular depression, which can also taper in depth, to approximately match the diameter of the mandrel 50.

The ring 76 with setting 78 to be processed is slipped over the end of the mandrel 50 and into a secure position along the length of the mandrel. The mandrel can be adjusted to center the ring under the tool driver 30 by releasing the clamp 60 and moving the mandrel holder 54 and retightening the clamp. The mandrel can also be rotated for rings having multiple settings. In this latter case, small detents or stops can be provided on the mandrel for predetermined positions when repetitive operations are desired.

To secure the ring 76 in place on the mandrel 50, two spring biased, rotatable, ring stops 80 are used. The ring stops 80 each comprise a cylindrical base portion 82 which is mounted in a matching passage 84 in a ring block 86 positioned on the work plate 44. The ring blocks 86 can be made of aluminum or similar material (preferably anodized) and secured to the work plate 44 using means such as bolts. The passages 84 in the blocks 86 are generally cylindrical and slightly larger than the diameter of the base portions 82 to allow free back and forth motion of ring stops 80.

Figure 4:
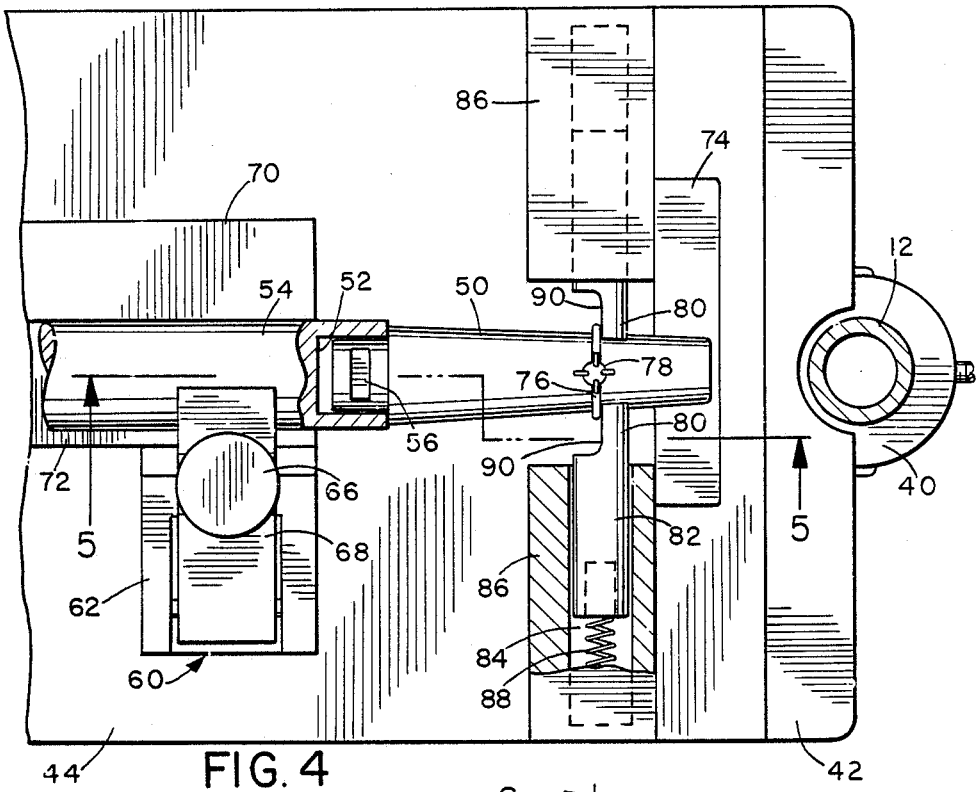
FIG. 4 is an enlarged sectional view taken on line 4—4 of FIG. 1.
Figure 5:
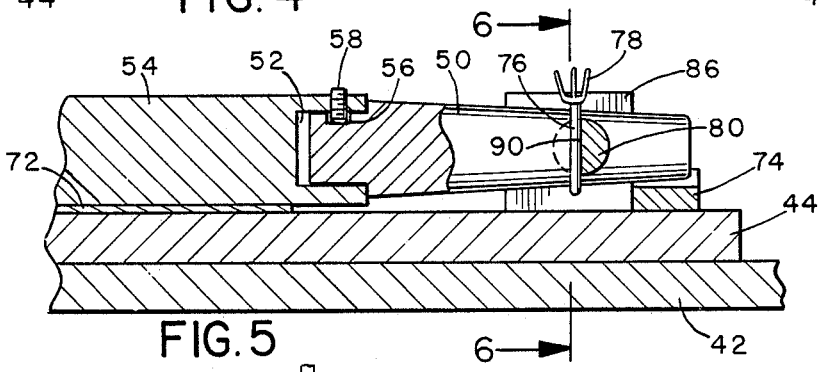
FIG. 5 is a sectional view taken on line 5—5 of FIG. 4.
Figure 6:
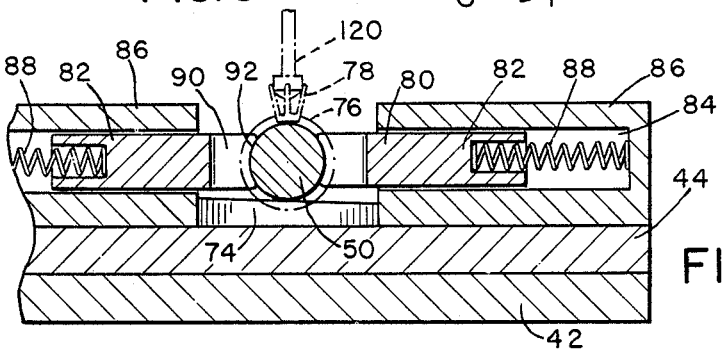
FIG. 6 is a sectional view taken on line 6—6 of FIG. 5.

As illustrated in FIGS. 4 and 6, an inset or depression in the base portion 82 accepts a spring 88 for pressing against a wall of the passage 84 and forcing the ring stops out of the passages 84 toward the mandrel 50. If desired, a small detent, pin, or other known device can be used to prevent the ring stops 80 from being ejected completely from the passages 84 when the mandrel 50 is removed.

The ends of the ring stops 80 extending toward the mandrel 50 have a portion cut away so as to form semi-cylinders with flat surfaces 90. The flat surfaces 90 press against the side of the ring and hold it in place on the mandrel 50. At the same time a semi-circular depression 92 in the end of the semi-cylindrical portion, allows the ring stops to fit snugly against the curved surface of the mandrel to provide maximum support or stopping power for a ring. The ring stops 80 are freely rotatable in the passages 84 to accommodate variations in ring width. That is, the surfaces 90 press against the ring even where the ring tapers between the top and the bottom.

Figure 8:
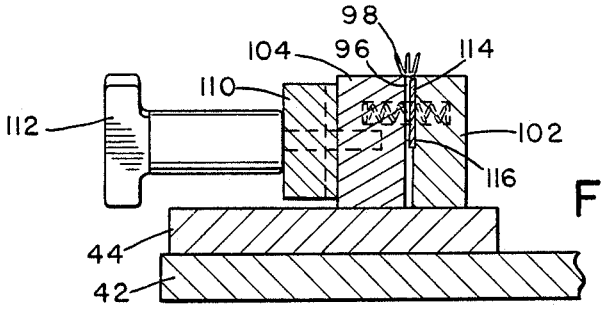
FIG. 8 is a sectional view taken on line 8—8 of FIG. 7.
Figure 9:
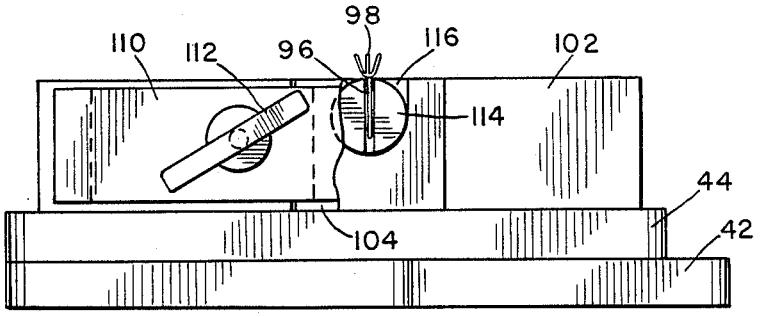
FIG. 9 is a front end view of the structure of FIG. 7.

In order to use the apparatus 10 with stud type settings 98 as for earrings or other jewelry mountings, a different clamping or vise structure is required to hold the setting in place during mounting. The structure envisioned for use in the preferred embodiment is illustrated in FIGS. 7 through 9.

Figure 7:
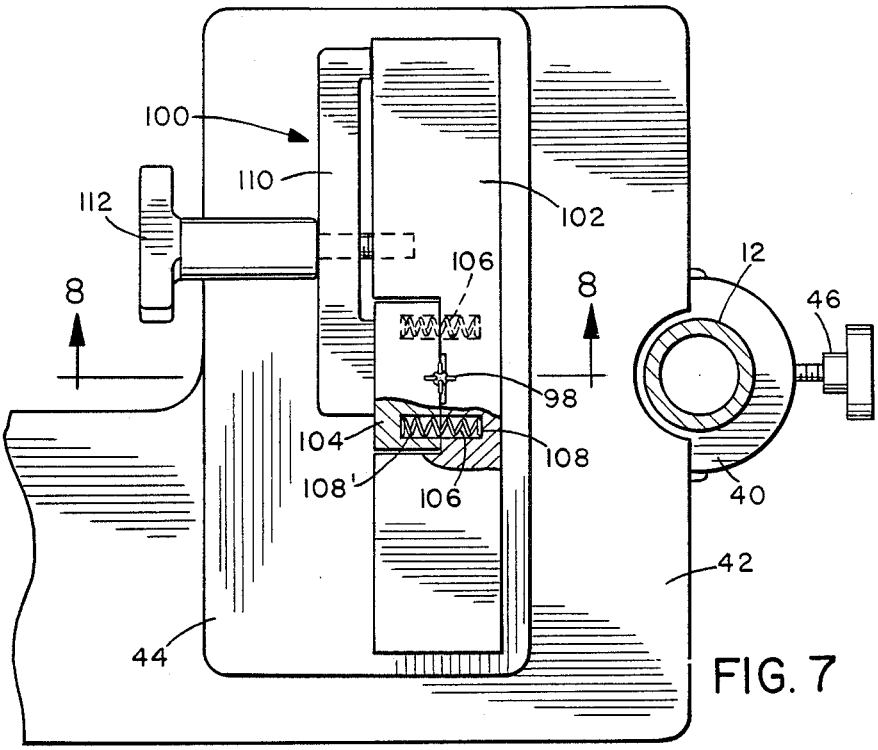
FIG. 7 is a view similar to FIG. 4, illustrating the invention set up for holding an earring type setting.

In FIG. 7 a stud vise assembly 100 is shown secured in place on the work plate 44 using bolts, pins, or similar means. The vise assembly 100 comprises a main setting base block 102 and a movable setting holder block 104. The holder block 104 is spring loaded, having two springs 106 extending out of passages 108 and into mating passages 108' in the block 104. This forces the two blocks apart allowing quick and sure release of the finished stud 96 without marring.

The blocks 102 and 104 are held together using a clamp lever arm 110 which is configured as an elongated "C" shaped member abutting the base block 102 on one end and the holder block on the other. The clamp lever arm is held in place against the blocks 102 and 104 using a handle and bolt combination 112, referred to as a T-screw handle. The T-screw extends through a hole in the arm 110 and into block 102.

If the blocks 102 and 104 are made from aliminum there may be a fair amount of wear over time as several studs 96 are processed. Such wear can lead to faulty alignment and damage. Therefore, a steel inset 114 is placed in the inner surface of the support block 102 facing the stud 96 in order to minimize such wear and provide a hard, sure surface against which the stud will be clamped. The surface of inset 114 facing the stud has a "V" groove for holding the stud 96 base. The inset 114 is pressed fit into a circular depression in the block 102. The inset can be replaced easily by prying out. As shown in FIGS. 8 and 9, the inset 114 is set flush along its edge with the top of the block 102 where clamping occurs.

Figure 10:
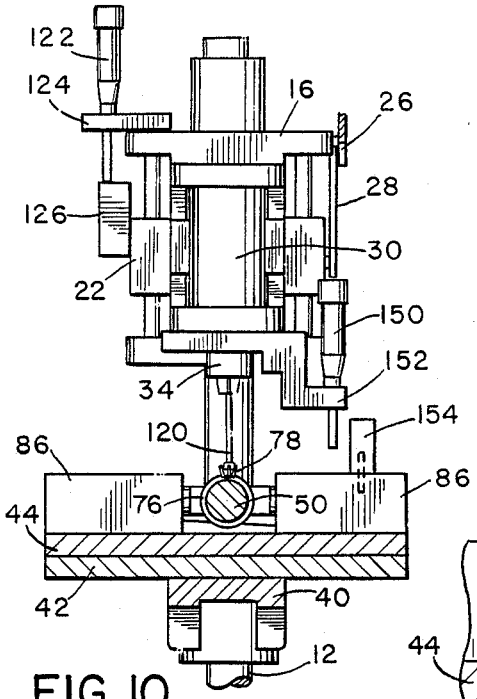
FIG. 10 is a view similar to FIG. 1, illustrating a seat cutting operation.

For the seat preparation step, as shown in FIG. 10, a sharp deburring tool or bit 120 is chosen for preparing the stone setting. The size of the bit 120 is chosen to be commensurate with the dimensions of the girdle on the stone to be mounted. Gemstones are generally graded in various carat sizes from ⅛ (or less) up to around 3 carats. For calibrated stones, ranging from 2 pts to 100 pts or more, the girdle dimensions are known by the carat size of the stone. Therefore, anyone wishing to mount a series of calibrated stones in a series of settings knows in advance the size of the stone girdle dimensions. Non-calibrated stones can be easily measured. The carat size of the stone is in turn determined by the type of jewelry production desired or ordered, as in the case of mass production, or from the size of stones on order by individual clients and customers.

With the desired seat size determined from the stone size, the cutting tool or bit 120 is chosen to clear away enough material for the stone. In practice, the inset edge forming the seat is made slightly wider than the stone girdle to allow for flexture of the prongs in bending and some "cushion" for the stone. In using the present invention it is contemplated that a chart can be provided for apparatus 10 operators, such as those without experience as jewelers, that would ascribe a fixed tool size to a fixed stone size. In this manner, while those skilled in the art would know the size of tool required, less than skilled personnel can utilize the invention to great advantage.

The cutting tool 120 is inserted in the tool driver 30 chuck and secured in place by a chuck key or similar device known in the art. The depth of cut is also understood as being determined by the thickness of the gemstone girdle and amount of prong material required to hold the stone asthetically.

The cutting tool is advanced downward toward the setting using the handle 26. To prevent over cutting, a micrometer 122 is installed on the carriage 16 to set the depth of the cut. This micrometer can be set for a minimum depth and adjusted as cutting proceeds to obtain the desired depth. The micrometer 122 is then left in the final cutting position for a series of similar stone seating cuts, especially for calibrated stones. This provides increased productivity by alleviating concern for the depth of each repetitive cut which will be controlled automatically.

This micrometer 122 is secured to the carriage 16 using a mounting block 124. A contact block 126 is mounted on the support block 22 for defining the limit of travel for the micrometer 122. The contact block 126 can be secured in place using a set screw or bolt and handle arrangement. The contact block 126 and support block 22 can also be formed from a single piece of material or manufactured as separate units.

During operation, as illustrated further in FIG. 10, the cutting bit 120 engages the ring setting 78 (or earring post 98, etc.) and cuts away unwanted material from the prongs. In order to assure a centered cut, it has been discovered that the cutting force of the spinning cutting bit 120 can be used to advantage. That is, in the prior art a jewelry person would lock the mounting securely in a fixed place and move the tool around the setting by hand. For this reason those skilled in the art would lock the work plate 44 in a stringently fixed position.

However, by fixing the vertical, but not lateral motion of the plate 44 along the vertical support 12, automatic setting alignment is realized. The freedom of motion for the setting to move slightly in the lateral direction means that any force exerted by the cutting tool 120 laterally against the prongs moves the setting.

In a prefectly centered cutting position the lateral force exerted by the cutting tool 120 against all of the prongs or posts is approximately equal. Therefore, the setting does not move. However, if the cutting tool 120 is offset with respect to any prong (more than with respect to the others), then one or more prongs receive a greater pressure from the cutting tool than do the others. The force against such prongs tends to move the prong and, therefore, the setting away from the cutting bit 120. This in turn brings the other prongs closer to the cutting bit so that the cutting operation is centered. Since the cutting tool spins at a very high speed, this self centering occurs very rapidly and without substantial variation in the setting.

When the cutting bit 120 reaches its maximum depth or downward limit of travel, the bolts 48 are tightened to hold the work plate 44 in a fixed position. This secures the setting in the centered position for subsequent operations. The plate 44 will again be loosened when the next setting is mounted in place.

Once the cutting bit 120 has removed the appropriate amount of material from the prongs, and the micrometer 122 has been adjusted for subsequent operations, a stone may be mounted in the setting. The stone mounting involves placing the stone in the setting and closing the upper portion of the support prongs over the stone girdle. This is accomplished by a swaging tool which is pressed against the prongs. The swaging tool must press down on the prongs evenly about the same center line for the setting as used for the cutting action in forming the seat. This is accomplished in the present invention by using a special swaging attachment for closing the ends of the prongs. This is better illustrated in FIGS. 11 through 14.

Figure 11:
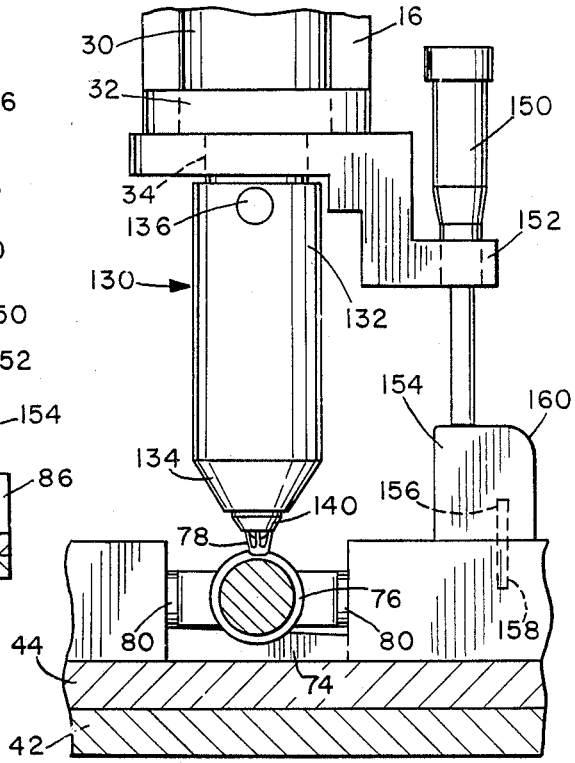
FIG. 11 is an enlarged view similar to a portion of FIG. 1, illustrating a swaging operation.
Figure 12:
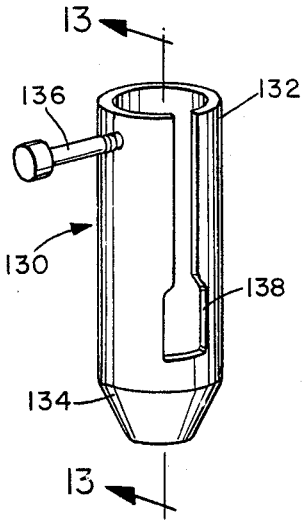
FIG. 12 is a perspective view of a swaging adapter.
Figure 13:
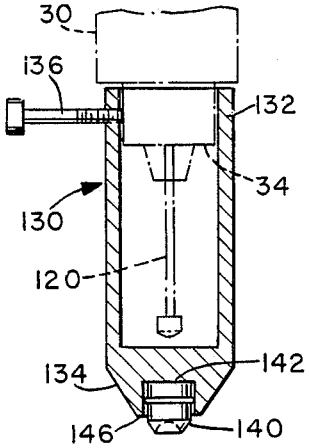
FIG. 13 is a sectional view taken on line 13—13 of FIG. 3.
Figure 14:
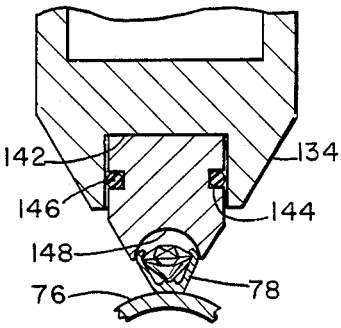
FIG. 14 is an enlarged view of a portion of FIG. 13, illustrating the swaging action.

In FIG. 11 a swaging attachment is shown which comprises a swage chuck 130 having a cylindrical housing with a top portion 132 which is sized to fit over the end of the chuck 34. Locking or set screws 136 on the side of the swage chuck 130 secure it in place on the tool driver chuck 34. In the alternative a series of spring loaded set screws, not shown, having smooth ball bearing type ends can be used. The ends of these set screws would preferably be positioned to align with holes in the sides of the tool chuck 34.

The top portion 132 of the swage chuck 130 is hollow to accommodate the cutting tool 120 and chuck 34. At least one slot 138 in the side of the swaging tool 130 provides clearance for the cutter 120 when mounting and dismounting the swage chuck 130 from the cutting tool assembly 30 without moving the setting or readjusting the carriage 16 position.

The swage chuck 130 and swage sockets, to be described, are automatically centered over the setting since the setting has aligned itself with the tool chuck 34 during cutting.

The base or bottom portion 134 of the swage chuck is a solid frustrated cone which haas a recessed passage 142 formed therein for holding a swaging head or socket 140 which deforms or molds the prongs over the stone girdle. The swage socket 140 is secured within the base 134 passage using an O-ring 144 mounted in a circular recess 146.

The swage socket or head 140 has a hemispherical opening or depression 148 which contacts the setting prongs. As the prongs engage the outer portion of the depression 148, they are slowly deflected inward toward the center of the stone, thus folding over the edge of the stone girdle. The preferred operation of the swage socket 140 bends the upper prongs over the girdle so that they extend 40–45% of the distance between the stone girdle and table.

Since the gem mounting apparatus 10 is meant to accommodate a variety of stone sizes, the swaging operation must also be adjustable. Therefore, a set of interchangeable swage sockets 140 arae provided, each having a different sized depression 148 to cover the previously mentioned setting size range. The swage sockets 140 are preferably manufaactured from a hard steel very smoothly polished to prevent any damage to the setting but retain its shape without scarring. The tip of the swage sockets 140 or the bottom portion 134 are made with a very narrow outer diameter so that the tip clears adjacent settings or material on a ring setting.

It is unnecessary and undesirable to press the swage head 140 down with more force than required to bend the prongs into contact. Therefore, a second micrometer, the mounting or swaging micrometer 150, is provided. This micrometer is secured to a micrometer support block 152 which has a central passage for the tool driver 30 housing. The micrometer block 152 is "C" shaped so that the block can be secured to the tool driver 30 in a manner similar to the mounting of the tool driver 30 to the carriage 16. While this is a simple and preferred embodiment, alternate means of support can be utilized for holding the micrometer block 152 to the tool driver 30 by using other fasteners and clamps. Oce the mounting micrometer 150 has been adjusted for the setting and stone size many repetitious operations can occur as before.

In order to accommodate both micrometers at the various heights without interfering with each other, a micrometer shim block 154, having a rounded corner 160, is used on top of one of the ring blocks 86 to act as the contact surface for micrometer 150. The shim block 154 acts as the defining point for the limit of the travel for the swage chuck 130 during the stone mounting. This allows a wider range of motion for the cutting tool 120 but a narrower range for the swage socket 140. This block is preferably held in place by one pin 156, inserted between the blocks 86 and 154. However, the shim block 154 can be secured in place using other means or left loose.

The pin 156 is threaded on one end and screwed into the block 154. The other end of the pin 156 is inserted into a hole 158 in the block 86. When secured in this fashion, the block 154 may be rotated out of the path of the micrometer 150 allowing cutting of new settings without resetting the swaging micrometer. This is illustrated in FIG. 10 where the block 154 is shown rotated.

The foregoing description of a preferred embodiment has been presented for purposes of illustration and description. It is not intended to be exhaustive nor to limit the invention to the precise form disclosed, and many modifications and variations are possible in light of the above teaching. The embodiment was chosen and described to best explain the principles of the invention and its practical application to thereby enable others skilled in the art to best utilize the invention in various embodiments and with various modifications as are suited to the particular use contemplated. It is intended that the scope of the invention be defined by the claims and their equivalents.

What I claim is:

1. An apparatus for mounting gemstones in prong type settings which automatically centers the setting while cutting a seat in the form on an inset edge in the ends of the prongs for holding a stone and swaging the ends of the prongs over a girdle of a stone positioned in the setting without manually moving the setting once secured in place, comprising:

a vertical support frame;

rotary tool driver means slidably mounted on said frame for imparting rotary motion to cutting tools mounted thereon about a central axis of rotation, being movable vertically between upper and lower predetermined limits of travel;

a rotary cutting tool coupled to said rotary tool driver means having a first central longitudinal axis aligned with said axis of rotation;

setting holder means adjustably mounted on said frame adjacent said rotary tool and tool driver means and for holding a setting vertically spaced apart from said rotary cutting tool when said tool driver is in an upper vertical position, and for allowing said setting to be freely movable in a plane transverse to said axis of rotation in response to an initial pressure from said cutting tool for automatically centering said setting about said axis of rotation but not allowing substantial movement along, or angular displacement about, said axis of rotation;

reciprocating means for moving said tool driver means in a reciprocating vertical motion parallel to said central axis of rotation between upper and lower positions;

stop means connected to said reciprocating means for controlling a minimum spacing distance between said cutting tool and the setting holder means; and swaging means removably coupled to said tool driver means for contacting the ends of said prongs after being cut by said cutting tool and bending a predetermined portion of said prong ends over the girdle of said stones, said swaging means having a second central longitudinal axis which automatically aligns with said axis of rotation when coupled to said tool driver means.

2. The apparatus of claim 1 wherein said rotary tool driver means comprises a rotating chuck assembly having input means for receiving a flexible rotary shaft.

3. The apparatus of claim 1 wherein said setting holder means comprises:

a work platform mounted on said vertical frame in a fixed vertical position relative to said tool driver means but having a self varying position transverse to said vertical frame in response to pressure on said setting from said cutting tool; and a setting support clamp secured to said work platform.

4. The apparatus of claim 3 wherein said setting support clamp comprises:

a cylindrical mandrel for holding a ring adjacent to said work platform, said mandrel having a tapered cross section of varying diameter along its length so as to accommodate a predetermined range of ring sizes on said mandrel, each ring being held in a position where the diameter of the mandrel coincides with an inner diameter of said ring;

a mandrel holder for securing said mandrel in place on said work platform; and retention means for preventing movement of the ring along the mandrel in a direction of decreasing mandrel diameter.

5. The apparatus of claim 4 wherein said mandrel holder comprises:

a clamp base secured to said work platform;

a clamp lever arm, configured in an inverted L shape having a side and a foot with the side of said L pivotally secured to said clamp base and the foot of said L resting against said mandrel holder; and pressure means for pressing on said clamp lever at a juncture of the foot and side so as to press an end of the foot of said lever arm against said mandrel holder.

6. The apparatus of claim 4 wherein said retention means comprises spring biased rotatable spring stops comprising:

first and second retainer support blocks mounted on said work plate on opposite sides of said mandrel, each block having a circular passage formed therein, said passages having a central longitudinal axis, and being positioned so that their the axis are in a plane running approximately through a central axis of said mandrel;

retainer fingers inserted into said passages, said retainer fingers having a cylindrical base portion positioned within said passage and a flat contact surfaces formed on an end facing said mandrel outside of said passage, said flat contact surface being positioned perpendicular to sides of said mandrel; and springs disposed between a bottom of said passages and said retainer finger so as to press said fingers against said mandrel.

7. The apparatus of claim 3 wherein said setting support clamp comprises:

a base clamp block mounted on said work platform, having a rectangular depression in a central location;

a setting holder block configured to slide into said depression for holding a stud type setting post against said base clamp block;

a lever type clamp arm positioned to extend from an exterior surface of said setting holder block to an exterior surface of said base block; and compression means for pressing against said clamp arm in a central location so as to force said setting block against said base block.

8. The apparatus of claim 1 wherein said swaging means comprises:

a swage chuck comprising a cylindrical housing having said second central longitudinal axis extending between a top and a bottom end and a passage extending along said second axis from said top end, being large enough to house a cutting tool attached to said tool driver means and a lower portion of said tool driver means;

said top end having means for attaching to said tool driver;

said bottom end comprising a solid conical body terminating in a diameter smaller than said top end, and having a circular depression therein; and a swaging socket disposed within said circular depression.

9. The apparatus of claim 8 wherein said swaging socket comprises:

a solid cylindrical body having a tapered bottom end projecting out of said circular depression; and a hemispherical depression formed in said tapered bottom end.

10. The apparatus of claim 9 wherein said swaging socket further comprises:

an annular recess about an outer portion of said solid cylindrical body with an O-ring disposed therein so as to contact between said swaging socket and said circular depression in said bottom end of said swage chuck to hold said swaging socket in place.

11. The apparatus of claim 8 wherein said swage chuck cylindrical housing further comprises at least one vertically extending slot formed in a side of said top portion of said housing, being wide enough to clear said cutting tool while secured to said tool driver means.

12. The apparatus of claim 1 wherein said reciprocating means for moving said tool driver means along said vertical frame comprises:

a support block secured to said vertical frame;

a support spring disposed around said vertical frame and contacting said support block on a first end and said carriage on a second end; and lever means attached to said carriage and said support block so as to force said carriage toward or away from said block against said spring when rotated about a pivot point.

13. The apparatus of claim 1 wherein said stop means comprises first and second micrometer support blocks attached to said carriage and first and second micrometers respectively mounted on said micrometer support block.

14. The apparatus of claim 1 wherein said rotary tool driver means comprises:

a carriage having at least one support bracket for slidably mounting on and moving vertically along said vertical support frame; and a rotating chuck assembly mounted on a power driven rotary shaft which is rotatably mounted on said carriage.

15. A method of mounting a gemstone in prong type settings by forming a seat in the configuration of an inset edge in the ends of the prongs and swaging the prong ends over a girdle of a stone, comprising the steps of:

providing a rotary tool driver slidably mounted on a vertical support frame, said driver being movable between an upper and a lower position along said frame and having a central axis of rotation;

mounting a rotary cutting tool on said tool driver means with a longitudinal axis aligned with said axis of rotation;

providing a work platform in spaced apart relationship from said tool driver, said platform having adjustable vertical height along said vertical frame and being self adjusting transverse to said axis of rotation in response to pressure from said cutting tool;

mounting a pronged setting on said platform, approximately centered under said cutting tool;

rotating said cutting tool about said axis of rotation sand engaging said setting with said tool so as to remove a predetermined portion of material from ends of said prongs with said cutting tool so as to form a seat for said gemstone;

placing the gemstone on said seat;

attaching a swage means having a swaging socket to said tool driver means, with said cutting tool in place in said driver; and bending the ends of said prongs over the edge of a girdle portion of said gemstone by pressing down on said prongs with said swaging socket.

16. The method of claim 15 further comprising the steps of:

mounting a setting in a setting holder positioned on a work platform secured to said vertical frame so as to allow transverse but not parallel motion of said setting with respect to said vertical support frame;

removing material from the ends of said prongs using said cutting tool; and securing said platform in place against said vertical frame while said cutting tool is extended into said setting at a predetermined maximum cutting depth in said prongs so as to prevent further lateral or vertical motion.

17. The method of claim 16 further comprising the steps of:

selecting a swaging socket having a hemispherical depression for bending said setting prongs, the size of said depression being determined by the size of the setting being used; and securing a swage chuck to said rotary tool driver means for holding said swaging socket, said chuck having a passage for enclosing said rotary cutting tool while positioned on said tool driver means; and inserting said waging socket into a depression in a bottom portion of said swage chuck.

18. The method of claim 17 further comprising the steps of:

attaching a second stop means on said rotary tool driver means for setting a minimum spacing between said rotary tool driver means and said setting; and adjusting said second stop means while said swage chuck is extended onto said setting at a predetermined maximum pressure position so as to set a fixed maximum pressure position for said swage chuck on subsequently mounted gemstone settings.

19. The method of claim 16 further comprising the steps of:

attaching a first stop means to said rotary tool driver means for setting a minimum spacing between said rotary tool driver means and said setting; and adjusting said stop means while said rotary cutting tool is extended into said setting at a predetermined maximum cutting depth in said prongs so as to set a fixed maximum penetration depth for said rotary cutting tool on subsequently mounted gemstone settings.

20. The method of claim 16 wherein the step of mounting said setting in a setting holder further comprises the steps of:

positioning a ring holding mandrel on said work platform, said mandrel having a central longitudinal axis and being shaped in the form of a decreasing diameter cylindroid, the mandrel central axis being positioned in approximate centered relationship with said cutting tool; and securing a ring on said mandrel by sliding said ring along said mandrel until the diameter of said mandrel matches an inner diameter of said ring;

releasably engaging said ring with a self adjusting and centering retention means; and locking said ring in place on said mandrel with said retention means.

* * * * *